US006626429B2

(12) United States Patent
Hauck

(10) Patent No.: US 6,626,429 B2
(45) Date of Patent: Sep. 30, 2003

(54) METHOD OF SETTING GUIDE ELEMENTS FOR A FLAT MATERIAL ON THE BASIS OF PRINTED-IMAGE INFORMATION

(75) Inventor: Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/944,571

(22) Filed: Aug. 31, 2001

(65) Prior Publication Data

US 2002/0036379 A1 Mar. 28, 2002

(30) Foreign Application Priority Data

Jul. 31, 2000 (DE) ..... 100 42 679

(51) Int. Cl.[7] ..... B65H 29/04

(52) U.S. Cl. ..... 271/206; 271/204; 271/82; 101/419; 101/416.1

(58) Field of Search ..... 271/82, 85, 204, 271/205, 206; 101/416.1, 419, 420

(56) References Cited

U.S. PATENT DOCUMENTS

| | | | | |
|---|---|---|---|---|
| 4,357,870 A | * | 11/1982 | Rudolph et al. | 101/246 |
| 4,643,414 A | | 2/1987 | Weisgerber | |
| 5,251,891 A | * | 10/1993 | Blaser et al. | 271/176 |
| 5,346,202 A | | 9/1994 | Jurkewitz | |
| 5,365,846 A | * | 11/1994 | Becker | 101/230 |
| 5,402,723 A | * | 4/1995 | Friedrichs et al. | 101/415.1 |
| 5,445,372 A | | 8/1995 | Blaser et al. | |
| 5,456,458 A | * | 10/1995 | Haupenthal | 271/276 |
| 5,480,138 A | * | 1/1996 | Haupenthal et al. | 271/276 |
| 5,483,888 A | * | 1/1996 | Greive | 101/232 |
| 5,501,447 A | * | 3/1996 | Haupenthal | 271/276 |
| 5,582,400 A | * | 12/1996 | Seydel | 271/176 |
| 5,749,294 A | * | 5/1998 | Ruf et al. | 101/232 |
| 5,765,483 A | * | 6/1998 | Klenk et al. | 101/239 |
| 6,050,192 A | * | 4/2000 | Kipphan et al. | 101/232 |
| 6,119,594 A | | 9/2000 | Kipphan et al. | |

FOREIGN PATENT DOCUMENTS

| | | |
|---|---|---|
| DE | 34 13 179 A1 | 10/1985 |
| DE | 42 01 480 A1 | 7/1993 |
| DE | 42 10 957 A1 | 10/1993 |
| DE | 43 21 179 A1 | 1/1995 |
| DE | 197 17 297 A1 | 11/1998 |
| DE | 199 10 244 A1 | 9/1999 |

* cited by examiner

*Primary Examiner*—Patrick Mackey
(74) *Attorney, Agent, or Firm*—Laurence A. Greenberg; Werner H. Stemer; Gregory L. Mayback

(57) ABSTRACT

A method of setting guide elements for a flat material along a printing-material conveying path in a rotary printing machine includes determining a job-specifically optimized actuating position for a positioning of sheet-guiding elements and of sheet-conveying elements by using job-specific printed-image information known from a prepress stage. The sheet-guiding elements and/or the sheet-conveying elements are positioned in relation to a printed image by using the determined job-specifically optimized actuating position.

19 Claims, 2 Drawing Sheets

METHOD OF SETTING GUIDE ELEMENTS FOR A FLAT MATERIAL ON THE BASIS OF PRINTED-IMAGE INFORMATION

BACKGROUND OF THE INVENTION

Field of the Invention

The invention relates to a method of setting sheet guide elements, such as guide brackets and brush wheels or pinwheels and sheet conveying elements, such as a sheet brake on sheet-processing machines.

Published, Non-Prosecuted German Patent Application No. DE 43 21 179 A1 relates to a method and a device for controlling or regulating operating processes in a printing machine. Through the use of the method proposed in this publication, the operating person is assisted in assuring quality on a printing machine. Through the use of the method proposed in this publication, the selection of a representative color measuring location by hand or automatically, as desired, is made possible, so that a regulation is ensured, the amount of rejects is considerably reduced and the effort and costs for the control or regulation of operating processes on a printing machine are reduced. Through the use of the solution proposed in this publication, coordinates for the measurement locations of an image recording device are determined from image information which reproduces at least the surface of a printed product. At each measurement location selected in such a way, the image recording device registers a measurement field with a defined prespecified size with high accuracy on the surface of the printed product. The method may be used in particular in rotary printing machines, which contain devices for handling, printing and treating sheets or other flat materials to be printed. In addition, the method disclosed by Published, Non-Prosecuted German Patent Application No. DE 43 21 179 A1 can be used to control devices which can be provided upstream or downstream of a printing machine, such as separating apparatuses, folders, cross cutters or slitters, gatherers, stacking devices, inserting devices, insertion machines, sorting machines and delivery configurations for delivering sheet or web material.

Published, Non-Prosecuted German Patent Application No. DE 42 01 480 A1 discloses a device for depositing flat material on a stack. A control device for pressure distribution of the blown-air or suction device is provided downstream of the blown-air or suction-air devices, together with an input device, so that data relating to the two-dimensional mass distribution of the printed sheet can be taken into account. Through the use of the blown-air or suction device, a pressure distribution which is correlated with the mass distribution can be produced on the deposit surface of the sheets. The device according to Published, Non-Prosecuted German Patent Application No. DE 42 01 480 A1 is used in all machines or apparatuses in which a previously printed or coated flat article, such as a sheet or the like or another sheet-like configured product can be conveyed onto a stack and deposited on the latter with the aid of grippers and a blown-air or suction device.

The aim of a stoppage-free passage of a printed sheet through one or more printing units of a printing machine processing sheet-like material is smear-free and scratch-free sheet guidance through the entire printing machine, in which the printed upper side or the already printed underside (in the case of turning) is not damaged; and this with optimal setting of the elements guiding the sheet material, such as small brush wheels or small pinwheels or sheet conveying elements assisting the sheet guidance, such as the sheet brake. This applies basically also to other sheet guiding elements as well, such as small pinwheels rotatably mounted on a stationary axis of rotation or brush wheels in the feed plane of a feeder of a rotary printing machine. In the case of multiple systems, what often occurs, for example, in the case of four-color printing on two-color machines and where the printed-image information from the color separations from the first pass can be evaluated, the optimal setting of the elements guiding the sheet material is likewise of importance.

The position settings of the elements that assist the sheet guidance through the printing units of the rotary printing machine, and therefore the paper run, are even nowadays mostly performed manually. Remotely adjustable positioning elements are still being developed. The positioning, to be performed manually, of the sheet guide elements assisting the sheet guidance through the rotary printing machine, if it is performed in a manual way, relies heavily on the judgment and experience of the operator of the rotary printing machine who carries it out. If an unpractised operator of the rotary printing machine performs such a setting, it is entirely possible that disruptions to the printed image occur as the printing material runs through the printing units provided one behind the other in a rotary printing machine. In addition to automatic adjustment, however, it may also be practical to provide the printer with the information as a setting recommendation within the context of presetting; the information can, for example, be output on the monitor and the machine operator can be given a first starting point for a setting to be performed.

In the case of conventional configurations from the prior art, the paper run depends to a great extent on the individual experience of the persons operating the printing machine.

SUMMARY OF THE INVENTION

It is accordingly an object of the invention to provide a method of setting guide elements for a flat material along a printing-material conveying path in a rotary printing machine which overcomes the above-mentioned disadvantages of the heretofore-known methods of this general type and which uses the printed-image parameters, already known from the production of the printed original (copy preparation) before the respective current print job is printed on the multicolor rotary printing machine, to preset sheet guide elements or sheet conveying elements on the printing units of the rotary printing machine in a job-specific manner.

With the foregoing and other objects in view there is provided, in accordance with the invention, a method of setting guide elements for a flat material along a printing-material conveying path in a rotary printing machine, the method includes the steps of:

- providing sheet-guiding elements in a printing-material conveying path, the sheet-guiding elements assisting in guiding a flat material;
- providing sheet-conveying elements having respective actuating positions adjustable relative to the flat material, the sheet-conveying elements influencing a sheet conveyance, the sheet-guiding elements and the sheet-conveying elements assisting a passage of the flat material through a printing machine;
- initially determining a job-specifically optimized actuating position for a positioning of the sheet-guiding elements and of the sheet-conveying elements by using job-specific printed-image information known from a prepress stage; and positioning at least one of the sheet-guiding elements and the sheet-conveying elements in relation to a printed image by using the job-specifically optimized actuating position determined in the determining step.

In other words, according to the invention, the object of the invention is achieved in that, in a method of setting guide elements for a flat material for a passage through the printing-material path on multicolor rotary printing machines, guide elements assisting the guidance of the sheet material, such as small guide wheels, guide brackets, brush wheels or pinwheels, being assigned to the printing-material conveying path, and sheet conveying elements, which influence the sheet conveyance and whose respective actuating position relative to the sheet material is adjustable, being provided, the following method steps are performed: first of all, the in job-specific terms optimal actuating position is determined for the positioning of the sheet-guiding and sheet guide elements assisting the run of the flat material through the printing machine, using the job-specific printed-image information known from the prepress stage, and using the determined optimal actuating position, the sheet-guiding or sheet conveying elements are automatically positioned in relation to the printed image.

With the method according to the invention for the job-specifically optimized positioning of sheet-guiding or sheet guide elements, firstly the manual setup of a new print job in relation to the positioning of a sheet-guiding or sheet guide element can be omitted. The quality of the sheet guidance, that is to say the fault-free conveyance of printing material through the printing machine, no longer depends only on the expertise or the level of experience of the machine operator but can be performed automatically within the context of presetting carried out in a job-specific manner. Associated with this, one advantage of the method proposed by the invention can be seen in the fact that a considerable saving in rejects can now be achieved. Furthermore, by removing the manual intervention by the operating personnel of the multicolor rotary printing machines, the level of automation and therefore the availability of the multicolor rotary printing machine that can be operated through the use of the method proposed according to the invention can be increased considerably.

According to an advantageous mode according to the invention, the in job-specific terms optimal actuating position is determined by using the color-separation-specific area coverage present in the printed image. Therefore, printed-image information already present at the prepress stage can be used not only for the color presetting, which is carried out zone by zone, but also for the positioning of sheet-guiding and sheet conveying elements.

According to the method proposed by the invention the in job-specific terms optimal actuating positions for sheet-guiding and sheet-conveying elements can advantageously be taken into account in dependence on the local area coverage. Given appropriate weighting when determining the optimal actuating position for each job, the sheet-guiding and sheet conveying elements can be set in areas of the printed image with the lowest possible area coverage.

According to a further advantageous mode of the method proposed by the invention, the in job-specific terms optimal actuating position is determined on the basis of printed colors or shades, the optimal actuating position preferably being placed in those sections of the printed image which are occupied by lighter shades or printing inks. The configuration of a sheet guide element, be it a guide bracket provided to be stationary and having an ink-repelling coating or a rotatable guide wheel provided on a stationary shaft, can be provided significantly less critically in a yellow colored area, for example, than in a black colored area.

During the determination of the optimal actuating position according to the invention for each print job, in order to determine these positions, the state of drying of the printed ink can also be taken into account as a function of the printing unit in which guide brackets, guide wheels or other sheet-guide or sheet-conveying elements such as sheet brakes have to be adjusted or displaced.

Through the use of the method proposed by the invention, given appropriate weighting or taking appropriate account of the local printed-image information, the local effect of the elements which can have a stronger effect on the sheet trailing edge or the sheet leading edge can be taken into account as well.

By including all of the printed-image information present in the prepress stage when setting an image on the printing plate or producing an original, such information including the data relating to recto and verso printing, data relating to the finishing or varnishing of the surface of the printed image, and also data relating to the damping solution to be applied or to the selection of the printing material to be printed, these parameters can likewise be included when determining the in job-specifically optimized actuating position for sheet-guiding and sheet-conveying elements. Information relating to the presence of recto and verso printing is, for example, particularly interesting in the case of sheets printed on both sides, in which the already printed underside of the sheet is acted on by a sheet brake in order to adapt the effect of the sheet conveying element to the ability of the freshly printed underside to withstand loading, that is to say its level of curing.

Accordingly, the method according to the invention offers the possibility not only of moving to optimal, in job-specific terms particularly favorable, actuating positions or setting position but of controlling the action of sheet-conveying elements, such as a pneumatic sheet brake, in such a way that the action of the sheet brake is increased in those areas of the flat material which are uncritical; and is restricted in effect in those areas of the sheet material in which there is an increased risk of smearing.

According to the method proposed by the invention, in job-specific terms optimal actuating positions of sheet-guiding and/or sheet-conveying elements can be determined in advance with the operator within the context of an interactive operation of a touch-screen monitor. The information relating to the printed image and already known from the prepress stage can be called up on the touch-screen monitor in order to display the printed image or the printing-unit-specific color separation.

According to a variant of the method according to the invention, guide elements for the sheets used for the further print processing carried out after the printing operation, such as grippers, pins, cutting knives or the like, used in the further print processing for printing-material processing equipment can be positioned, by using the image data of the printed sheet, which is known from the prepress stage, and with knowledge of the relevant imposition scheme or output program, in such a way that any impairment to the finished printing-material surface varnished in a finishing unit is prevented.

With the method proposed by the invention, the printed-image information need not be used just for the zonal ink presetting, in which only the average zonal area coverages are determined. The prepress stage provides a whole range of job-specific data, which can be used for setting print-job-specific parameters on a multicolor rotary printing machine if, during the presetting, they can be carried out independently of the machine operator, no longer manually but now automatically through the use of actuating drives provided on the printing units of the multicolor printing machine.

According to another mode of the invention, the job-specifically optimized actuating position determined in the determining step is provided to a printer as a setting recommendation for a manual setting.

Although the invention is described herein as embodied in a method of setting guide elements for a flat material along a printing-material conveying path, it is nevertheless not intended to be limited to the details described, since various modifications and changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENTS

Figure 1:
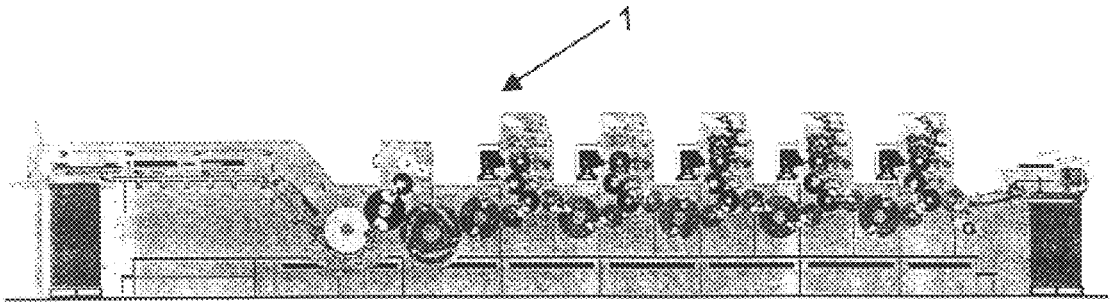
FIG. 1 is a diagrammatic, side-elevational view of a rotary printing machine.
Figure 3:
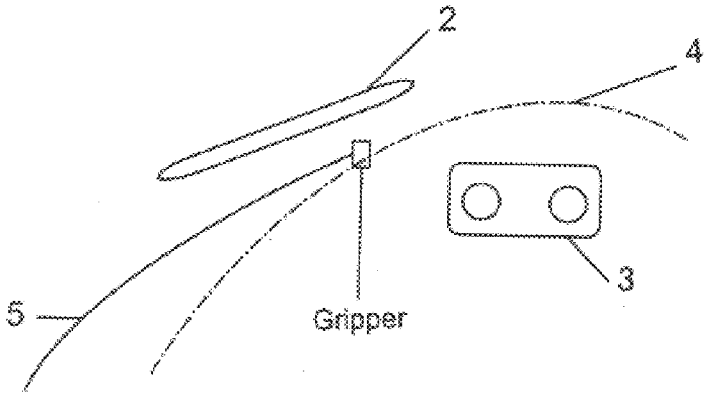
FIG. 3 is a simplified, side-elevational view of a portion of the printing machine of FIG. 1, showing a sheet guided by a guide bracket in a sheet-conveying path.
Figure 2:
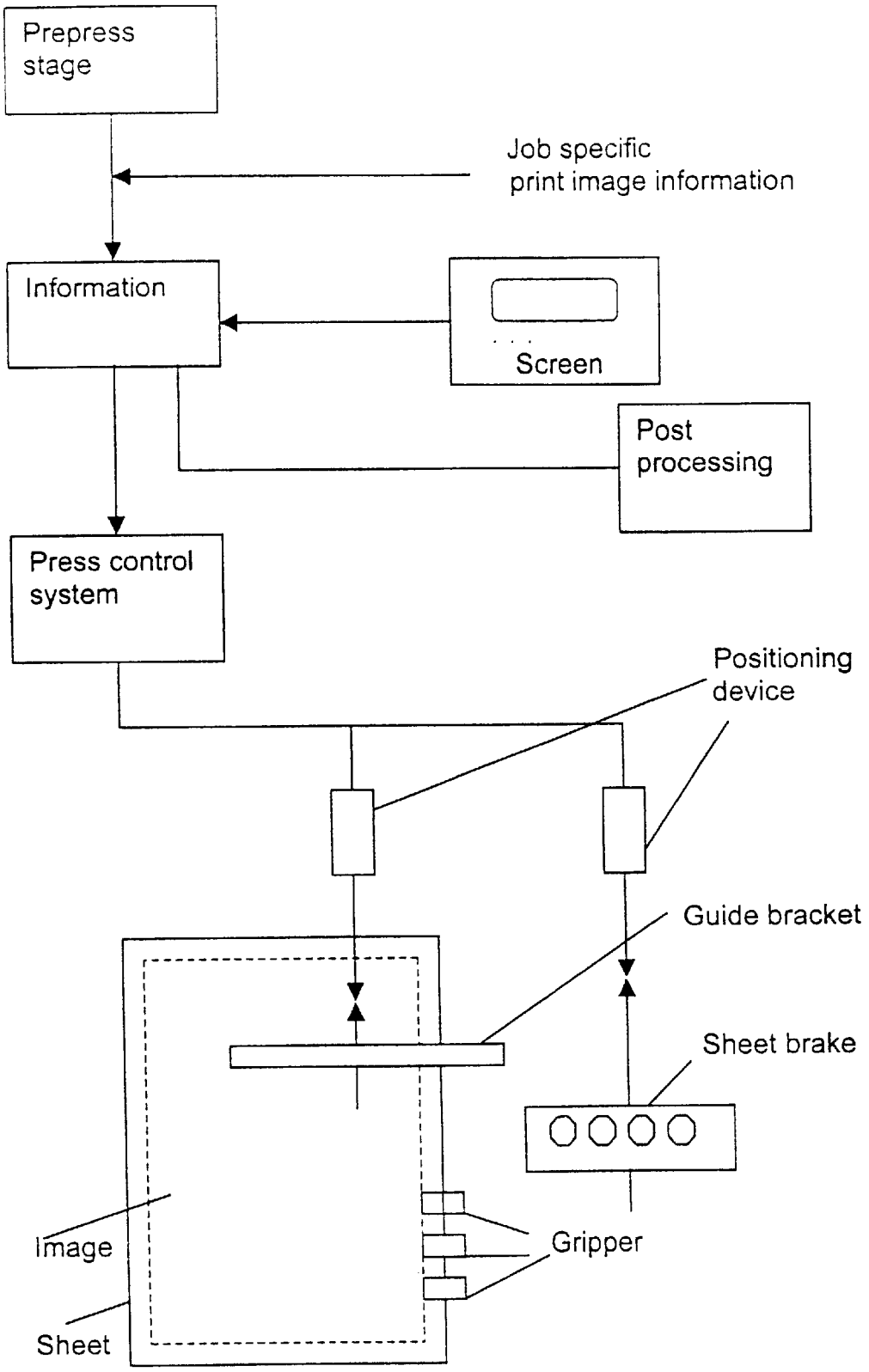
FIG. 2 is a diagram showing the method of setting guide elements for a flat material along a printing-material conveying path in a rotary printing machine according to the present invention.

Referring now to the figures of the drawings in detail and first, particularly, to FIG. 1 thereof, there is seen a rotary printing machine 1. FIG. 3 shows sheet-guiding elements 2 and sheet-conveying elements 3 provided in a printing-material conveying path 4 for assisting in guiding a sheet 5 in the printing machine. FIG. 2 is a diagram showing the method of setting guide elements for a flat material along a printing-material conveying path in the rotary printing machine.

According to this method, the job specific print image information is collected in a prepress stage. This information is then used to determine a job-specifically optimized actuating position for positioning of the sheet-guiding elements and the sheet-conveying elements.

The determination of in job-specific terms optimal positions and settings takes into account both sheet-guiding and sheet-conveying elements which act actively on the sheets in terms of their effect on the sheet run or in terms of their effect on the printing-material surface. As a result, information such as the presence of printing only on one side of the printing-material surface in recto printing or, respectively, the printing of the printing material on both sides, on the upper side and underside, are included in the determination of the optimal, in job-specific terms optimal actuating positions for the sheet-guiding and sheet-conveying elements.

In addition, the thickness of the printing material, the type of printing material, be it a printing material with a good or poor ink absorption behavior, and also the fiber orientation in the printing material can be set into the determination of the in job-specific terms optimal actuating positions for sheet-guiding and sheet-conveying elements.

The in job-specific terms optimal positioning of sheet guide elements held in a stationary position, such as guide brackets or rotationally movable sheet guide elements, such as pinwheels or sheet conveying elements which act actively on the sheet, can be determined in a job-specific manner for the current print job. Job-specific determination is to be understood to mean that the influencing factors mentioned in relation to determining the actuating positions of sheet-guiding or sheet-conveying elements can quite possibly be taken into account in a different manner specific to a print job and can be weighted differently.

The in job-specific terms optimal positioning is performed by using a weighting of the local area coverage. In this case, it is beneficial to set the actuating positions of sheet-guiding and sheet-conveying elements in those areas of the printed image in which there is a low area coverage, since there the risk of smearing is lowest because of the low ink coverage of the printing-material surface.

The sheet-guiding and sheet-conveying elements contacting the freshly printed surface of the printing material, that is to say of the flat material, also have to be checked with regard to the printed colors when determining their optimal job-specific position. It has been shown that lighter shades, such as shades lying in the yellow range, are considerably less sensitive with respect to contact with the stationary or rotating sheet guiding elements, as compared with full-area black printed areas of the printed image. Consequently, when determining the in job-specific terms optimal actuating position of sheet-guiding and sheet-conveying elements, emphasis should be placed on the fact that these are provided in areas which have light shades on the printed image if the printed image does not include any areas with low local area coverage, in which the optimal actuating positions of the sheet-guiding or sheet guide elements should preferably be located.

With the method proposed by the invention, the position of the printing units relative to the sheet guide element can also be taken into account, that is to say the state of drying of the freshly printed surfaces can be taken into account when positioning the sheet-guiding and sheet-conveying elements, depending on the order of the printing units which have already been passed through in a multicolor rotary printing machine. With regard to the state of drying of the printed ink on the surfaces of the sheet material in recto printing or in recto and verso printing, a long absorption time is less critical.

When determining the in job-specific terms optimal actuating position for sheet-guiding and sheet-conveying elements, it is, moreover, also possible for the local effect of the sheet-guiding or sheet-conveying elements that make contact the sheet surface to be taken into account. Given appropriate weighting within an algorithm which carries out the determination of the optimal position, it is possible to take into account the fact that a sheet guide bracket held in a stationary position has more significant effects on the printed-sheet leading edge in the sheet running direction than on its trailing edge. This can be taken into account when determining the optimal actuating position, it being quite possible for the weighting of this influencing factor to be different from job to job when determining the in job-specific terms optimal actuating position.

When determining the in job-specific terms optimal actuating position, the entire print job, that is to say its individual data, which are known from the prepress stage, can be taken into account. For example, data relating to existing recto printing or existing recto and verso printing can be introduced into the determination of the optimal actuating position, as can information relating to whether the surface of the printed sheet on one or both sides has passed through a finishing unit in the shape of a varnishing unit, or which printing material is specifically to be used in this job.

In addition, the method proposed by the invention not only offers the possibility of determining the in job-specific terms optimal actuating positions of sheet-guiding and sheet-guide element but, with the method proposed by the invention, it is possible for example for sheet-conveying elements to be influenced in terms of their effect. A sheet-conveying element, for example in the shape of a sheet brake, which in recto and verso printing acts on the freshly printed underside of the sheet material with suction, must be restricted in its effect in areas of the printed image with a high ink coverage which has not yet dried out completely, while the sheet brake could act with full effect on the underside of the sheet material in those areas of a sheet material printed in recto and verso printing in which only a low ink coverage has been formed or in which lighter shades prevail.

Furthermore, with the method proposed by the invention, in addition to determining the optimal actuating position, it is possible to achieve the situation where braking action of a sheet brake, as is generally provided upstream of the output area in sheet-processing rotary printing machines, is influenced in terms of its braking action in such a way that the braking action in the leading part of the sheet is higher than in the trailing part of the sheet if, in the trailing part of the sheet, the ink coverage is particularly critical or drying or initial curing of the surface of the printed surface may not yet have taken place.

A further possibility with the method proposed by the invention is of moving automatically to in job-specific terms optimal actuating positions for sheet-guiding and sheet-guide elements, without the manual intervention of the printer from printing unit to printing unit through a multi-color rotary printing machine, which is particularly time-critical, the setting of the sheet guide elements can be carried out interactively via a touch-screen monitor and the machine operator. In turn, the data required to prepare the printed image in the touch-screen monitor may be determined in a simple way from the printed-image information already present in the prepress stage.

A further variant of the use of the method proposed by the invention lies in further print processing, which generally follows the printing of a flat material. Sheet-conveying or sheet-guide elements in the shape of grippers or pins or cutting knives can be positioned relative to the already processed products, which may be folded or bound, in such a way that no impairment of the printed image occurs. This assists, in particular, rapid further processing of the already printed material. Using the data about the printed sheet already known from the prepress stage and with knowledge of the imposition scheme or output scheme, appropriate information for the sub-products can be used, so that a conversion can be carried out which ensures that, during the further print processing, the in job-specific terms optimal position for this operation can be determined, which may quite possibly differ from the in job-specific terms optimal positions for sheet-guiding or sheet-guide elements during the printing operation.

I claim:

1. A method of setting guide elements for a flat material along a printing-material conveying path in a rotary printing machine, the method which comprises:

providing sheet-guiding elements in a printing-material conveying path, the sheet-guiding elements assisting in guiding a flat material;

providing sheet-conveying elements having respective actuating positions adjustable relative to the flat material, the sheet-conveying elements influencing a sheet conveyance, the sheet-guiding elements and the sheet-conveying elements assisting a passage of the flat material through a printing machine;

initially determining a job-specifically optimized actuating position for a positioning of the sheet-guiding elements and of the sheet-conveying elements by using job-specific printed-image information known from a prepress stage; and positioning at least one of the sheet-guiding elements and the sheet-conveying elements in relation to a printed image by using the job-specifically optimized actuating position determined in the determining step.

2. The method according to claim 1, which comprises determining the job-specifically optimized actuating position by using a color-separation-specific area coverage present in the printed image.

3. The method according to claim 2, which comprises taking a local area coverage of the printed image into account and weighting the local area coverage of the printed image when determining the job-specifically optimized actuating position.

4. The method according to claim 1, which comprises:

taking at least one print property selected from the group consisting of a printed color and a printed color tone into account when determining the job-specifically optimized actuating position; and placing the job-specifically optimized actuating position in first printed areas of the printed image, the first printed areas of the printed image being more lightly printed than second printed areas of the printed image.

5. The method according to claim 1, which comprises taking a state of drying of a printed ink depending on an order of printing units into account when determining the job-specifically optimized actuating position.

6. The method according to claim 1, which comprises taking local effects of the sheet-guiding elements and the sheet-conveying elements on a sheet material into account when determining the job-specifically optimized actuating position.

7. The method according to claim 1, which comprises taking all print-job data with regard to a recto printing, a recto/verso printing, a varnishing to be performed, a damping setting and a printing material to be printed into account when determining the job-specifically optimized actuating position.

8. The method according to claim 1, which comprises placing an action of at least a given one of the sheet-conveying elements in uncritical areas of the printed image subsequent to the step of determining the job-specifically optimized actuating position.

9. The method according to claim 1, which comprises placing an action of a sheet brake in uncritical areas of the printed image subsequent to the step of determining the job-specifically optimized actuating position.

10. The method according to claim 1, which comprises selecting the job-specifically optimized actuating position in an interactive manner with an operator.

11. The method according to claim 1, which comprises selecting the job-specifically optimized actuating position on a touch-screen monitor in an interactive manner with an operator.

12. The method according to claim 11, which comprises providing the printed image and the job-specific printed-image information from the prepress stage as information that can be called up on the touch-screen monitor.

13. The method according to claim 1, which comprises positioning guide elements for a further print processing by using image data from a printed sheet and from an imposition scheme such that an impairment of the printed image is prevented.

14. The method according to claim 13, which comprises providing at least one of grippers and pins as the guide elements for the further print processing.

15. The method according to claim 1, which comprises providing the job-specifically optimized actuating position determined in the determining step to a printer as a setting recommendation for a manual setting.

16. The method according to claim 1, which comprises performing an automatic positioning based on the job-specifically optimized actuating position determined in the determining step.

17. The method according to claim 1, which comprises providing, as the sheet-guiding elements, elements selected from the group consisting of guide brackets, brush wheels, and pinwheels.

18. The method according to claim 1, which comprises providing circulating belt elements as the sheet-conveying elements.

19. The method according to claim 1, which comprises providing, as the sheet-conveying elements, circulating belt elements selected from the group consisting of grippers, belts, suction devices and sheet brakes.

* * * * *

UNITED STATES PATENT AND TRADEMARK OFFICE

CERTIFICATE OF CORRECTION

PATENT NO. : 6,626,429 B2
DATED : September 30, 2003
INVENTOR(S) : Axel Hauck

It is certified that error appears in the above-identified patent and that said Letters Patent is hereby corrected as shown below:

Title page,
Item [30], should read as follows:
-- Aug. 31, 2000 (DE) …… 100 42 679.4 --

Signed and Sealed this

Twenty-third Day of December, 2003

JAMES E. ROGAN
*Director of the United States Patent and Trademark Office*